US006360467B1

(12) United States Patent
Knight

(10) Patent No.: US 6,360,467 B1
(45) Date of Patent: Mar. 26, 2002

(54) MUZZLELOADING RIFLE WITH PIVOTAL BOLT ACTION

(75) Inventor: William A. Knight, Centerville, IA (US)

(73) Assignee: Ebsco Industries, Inc., Birmingham, AL (US)

( * ) Notice: Subject to any disclaimer, the term of this patent is extended or adjusted under 35 U.S.C. 154(b) by 0 days.

(21) Appl. No.: 09/491,216

(22) Filed: Jan. 25, 2000

Related U.S. Application Data

(60) Provisional application No. 60/117,296, filed on Jan. 26, 1999, now abandoned.

(51) Int. Cl.[7] ..... F41C 9/08
(52) U.S. Cl. ..... 42/51; 42/16; 42/70.08
(58) Field of Search ..... 42/51, 16, 70.05, 42/70.08; 89/1.3

(56) References Cited

U.S. PATENT DOCUMENTS 3,757,447 A * 9/1973 Rowe ..... 42/51
5,467,551 A * 11/1995 Kruse ..... 42/51
5,915,934 A 6/1999 Knight et al. ..... 42/51
5,960,574 A * 10/1999 Lameiras Guede ..... 42/51

FOREIGN PATENT DOCUMENTS

FR 548957 * 1/1923 ..... 42/51

* cited by examiner

*Primary Examiner*—Stephen M. Johnson
(74) *Attorney, Agent, or Firm*—Zarley, McKee, Thomte, Voorhees & Sease PLC

(57) ABSTRACT

A muzzleloading rifle has a stock, a receiver, a forwardly extending barrel, a removable breech plug in the rearward end of the barrel and forwardly of the receiver, and a trigger mechanism. An elongated bolt member has a rearward end pivotally secured within the receiver and adapted to be pivoted from an aligned position within the receiver to an angular position outwardly through a slot in the side of the receiver. A transverse cross lug is mounted in a locking position within the receiver and has one end pivotally secured to the bolt so that when the bolt is pivoted outwardly from the receiver, the cross lug will be unlocked from the receiver to allow the bolt to be moved to a rearward position in the slot of the receiver. The bolt is operatively connected to an elongated striker pin in the bolt to pull the striker pin rearwardly against a compression spring when the bolt is moved forwardly to cock the striker pin. The trigger mechanism operatively releasably engages and holds the striker pin against forward movement when the bolt is moved forwardly and thence pivoted laterally to resume an aligned position within the receiver.

6 Claims, 6 Drawing Sheets

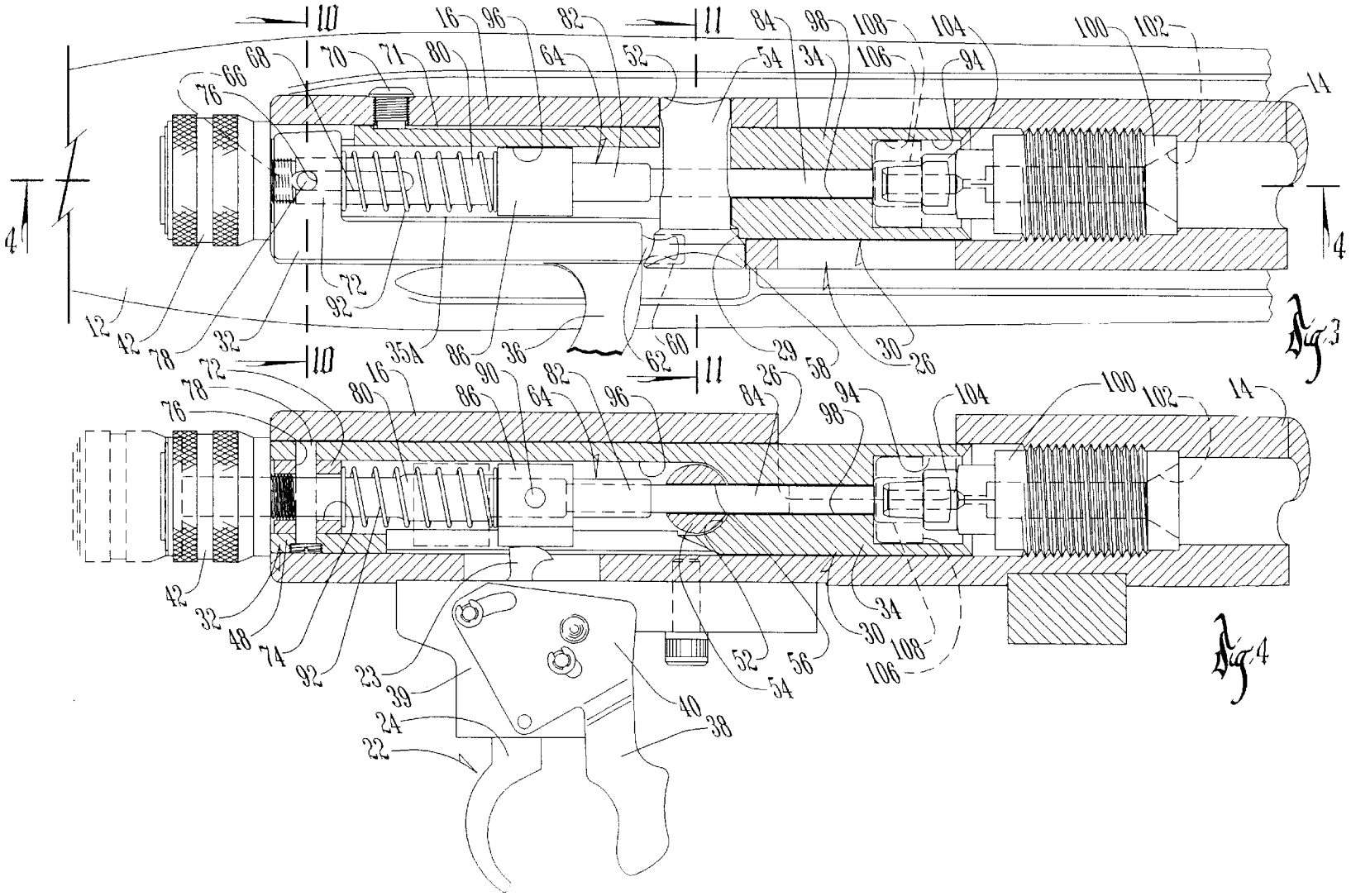

34
58
59
62
54
36
90
35A
32
86
35
92
64
68
51
78
42
52
71
48
50
46
35A

MUZZLELOADING RIFLE WITH PIVOTAL BOLT ACTION

CROSS-REFERENCE TO RELATED APPLICATIONS

This application claims the benefit of U.S. Provisional Application Ser. No. 60/117,296 filed Jan. 26, 1999 now abandoned.

BACKGROUND OF THE INVENTION

Rifles using a pivotal and reciprocal bolt have been previously used for rim fire rifles. The bolt is pivoted by its rearward end within the receiver and is normally locked against longitudinal movement by a cross lug that pivotally engages the forward end of the bolt and the receiver. To unlock the bolt, it is pivoted outwardly from the receiver to disengage the cross lug, and is then pulled rearwardly and thence forwardly to cock the rifle.

While this type of bolt action has some advantages, it has never been adapted to muzzleloading rifles or to center fire in line weapons.

It is therefore a principal object of this invention to provide a muzzleloading rifle having a pivotal reciprocal bolt for center firing.

A further object of this invention is to provide a muzzleloading rifle having a pivotal reciprocal bolt for center firing, and which has a safety lever located forwardly of the trigger mechanism.

These and other objects will be apparent to those skilled in the art.

SUMMARY OF THE INVENTION

A muzzleloading rifle has a stock, a receiver, a forwardly extending barrel, a removable breech plug in the rearward end of the barrel and forwardly of the receiver, and a trigger mechanism.

An elongated bolt member has a rearward end pivotally secured within the receiver and adapted to be pivoted from an aligned position within the receiver to an angular position outwardly through a slot in the side of the receiver. A transverse cross lug is mounted in a locking position within the receiver and has one end pivotally secured to the bolt so that when the bolt is pivoted outwardly from the receiver, the cross lug will be unlocked from the receiver to allow the bolt to be moved to a rearward position in the slot of the receiver. The bolt is operatively connected to an elongated striker pin in the bolt to pull the striker pin rearwardly against a compression spring when the bolt is moved forwardly to cock the striker pin.

The trigger mechanism operatively releasably engages and holds the striker pin against forward movement when the bolt is moved forwardly and thence pivoted laterally to resume an aligned position within the receiver.

BRIEF DESCRIPTION OF THE DRAWINGS

FIG. 3 is a partial sectional view taken on line 3—3 of FIG. 2;

FIG. 4 is a partial sectional view taken on line 4—4 of FIG. 3 with the striking pin in a fired position with the trigger sear in a relaxed position;

DETAILED DESCRIPTION OF THE PREFERRED EMBODIMENT

Figure 1:
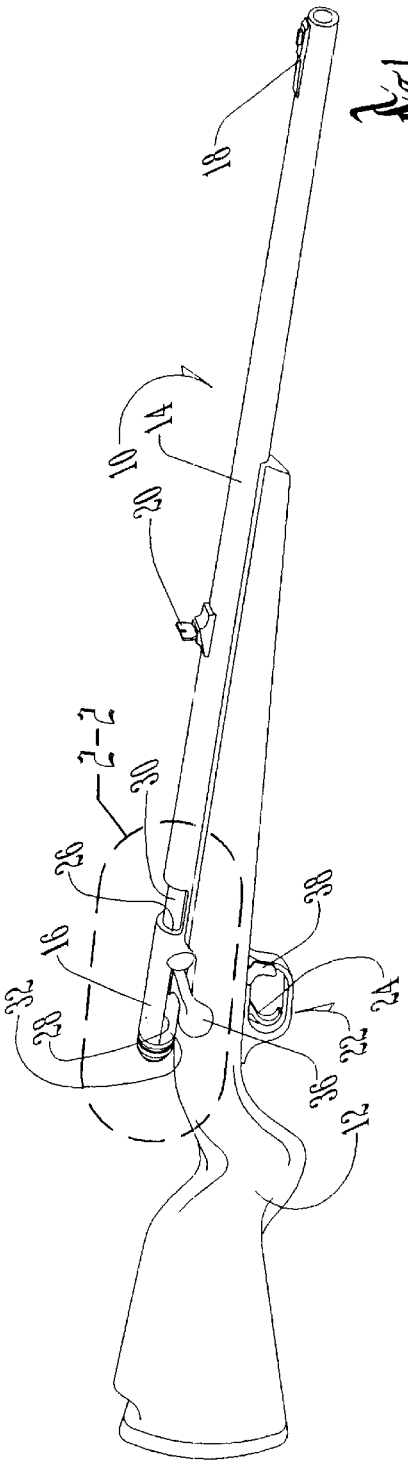
FIG. 1 is a perspective view of the rifle of this invention.
Figure 5:
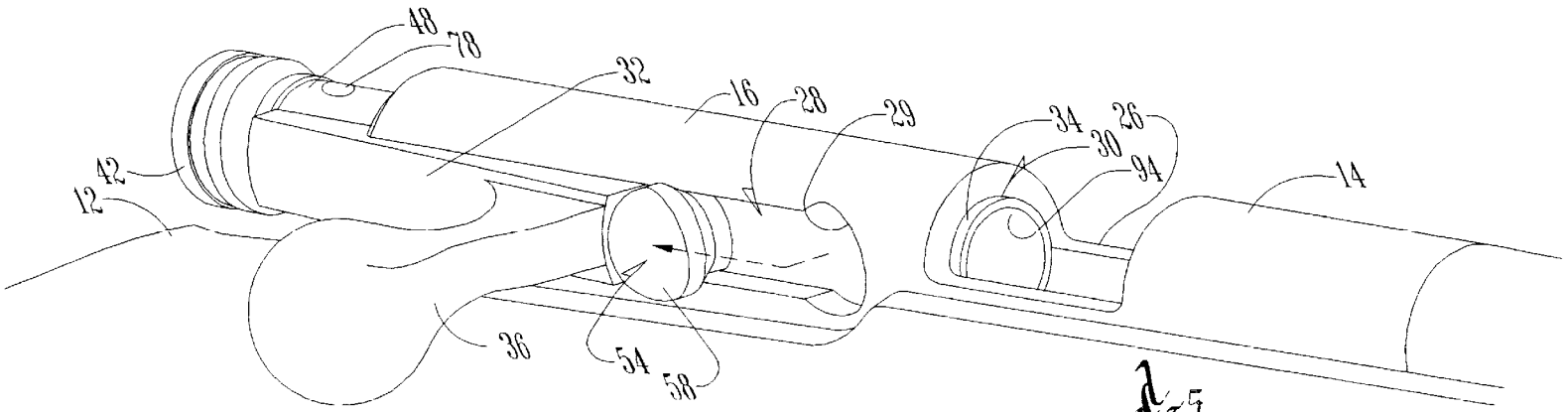
FIG. 5 is an enlarged scale perspective view similar to that of FIG. 2 but with the bolt handle pulled outwardly and rearwardly.
Figures 9, 10, 11, 12:
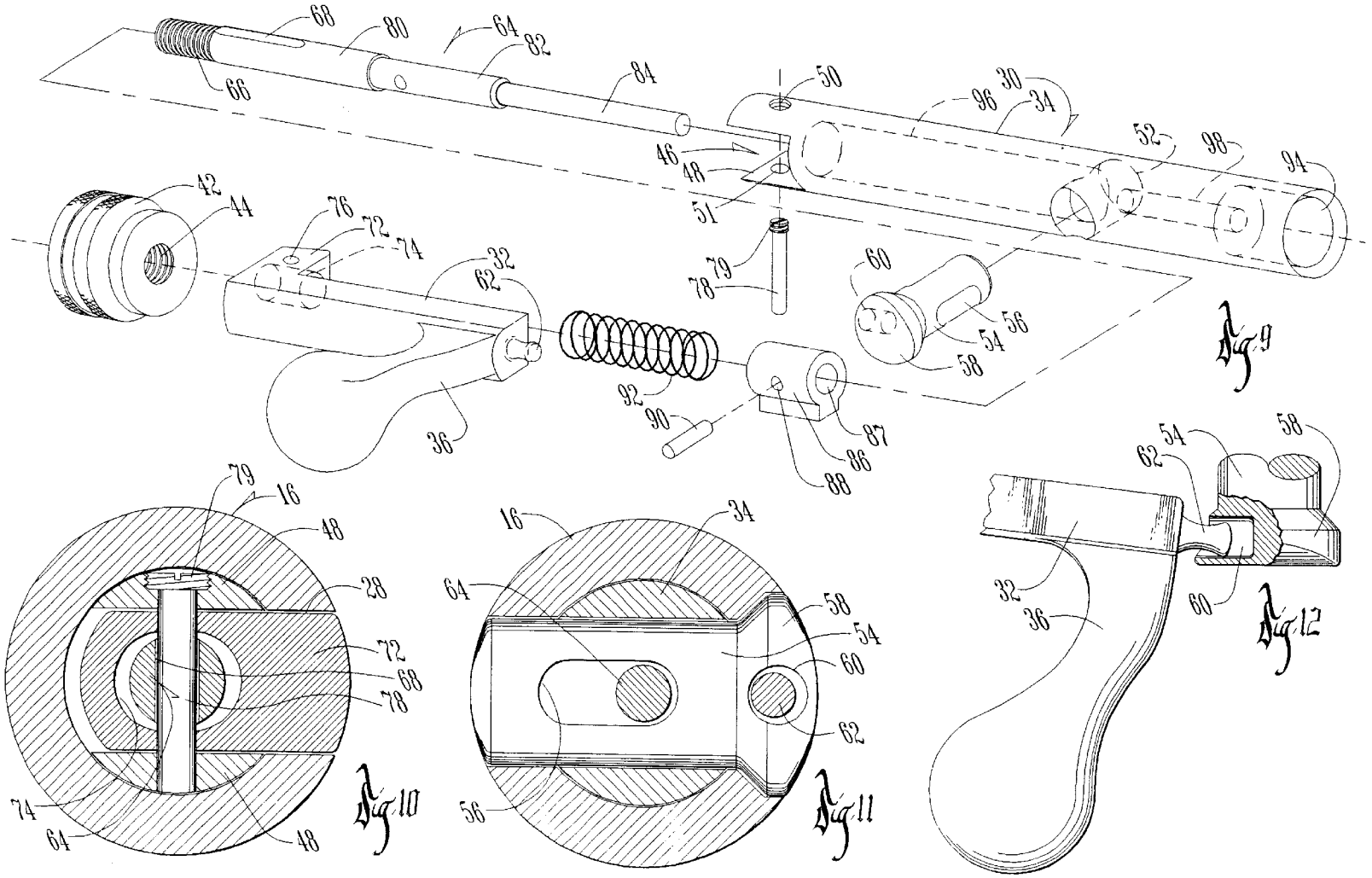
FIG. 9 is an exploded view showing the components of the bolt.
FIG. 10 is an enlarged scale sectional view taken on line 10—10 of FIG. 3.
FIG. 11 is an enlarged scale sectional view taken on line 11—11 of FIG. 3.
FIG. 12 is an enlarged scale partial sectional view taken on line 12—12 of FIG. 6.

The muzzleloading rifle 10 as shown in FIG. 1 has a stock 12, a barrel 14, a receiver 16, a forward sight, a rear sight 20, a trigger mechanism 22, trigger sear 23 (FIG. 4), and a trigger 24. A forward opening 26 appears in the upper half of receiver 16 to facilitate the loading of the rifle 10. An elongated longitudinal slot 28 appears in the side of the receiver 16, with the forward end thereof terminating in an arcuate notch 29 (FIG. 5). A bolt 30 is movably mounted within the rearward end of the hollow receiver 16 and includes a bolt slide 32, a bolt segment 34, and a bolt handle 36 (FIG. 9). Bolt segment 34 includes an L-shaped slot opening 35 (FIG. 13) and an elongated flat surface 35A (FIG. 15) to dwell adjacent bolt slide 32. The bolt handle 36 extends laterally outwardly from the forward end of bolt slide 32 (FIG. 9). A safety lever 38 on block 39 extends outwardly through a slot (not shown) in stock 12 from safety mechanism 40 (FIG. 4) and dwells forwardly of trigger 24. A safety knob 42 is positioned rearwardly of the rearward end of bolt slide 32 as will be discussed more fully hereafter. The safety knob 42 has a threaded center bore 44.

Figure 7:
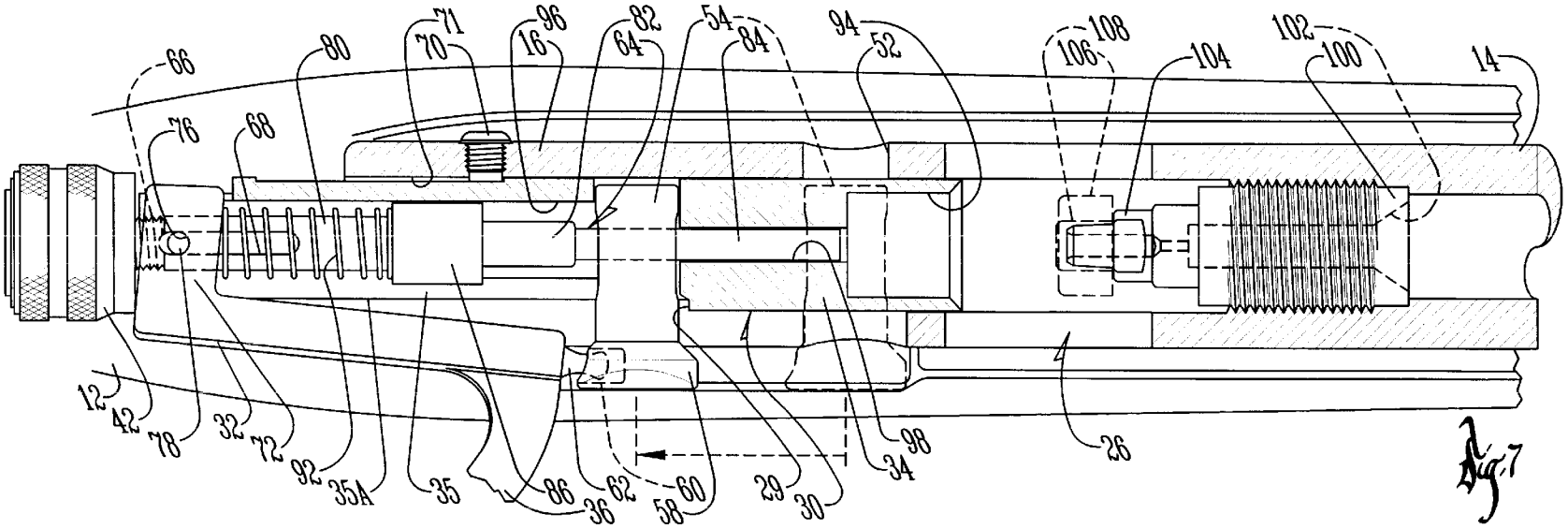
FIG. 7 is a sectional view similar to that of FIG. 6 with the bolt and striker pin being pulled to a rearward position into a relaxed mode.
Figure 8:
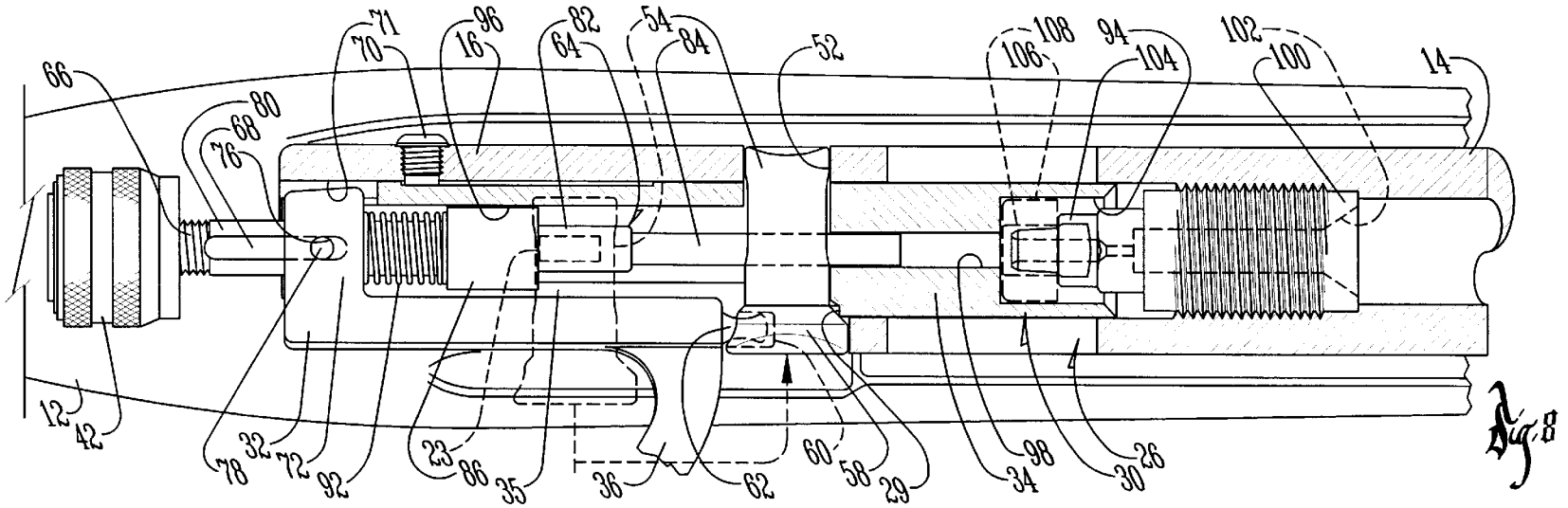
FIG. 8 is a partial sectional view similar to that of FIG. 7 but showing the bolt returned to its original position and the striker pin left in its firing position.
Figures 13, 14, 15:
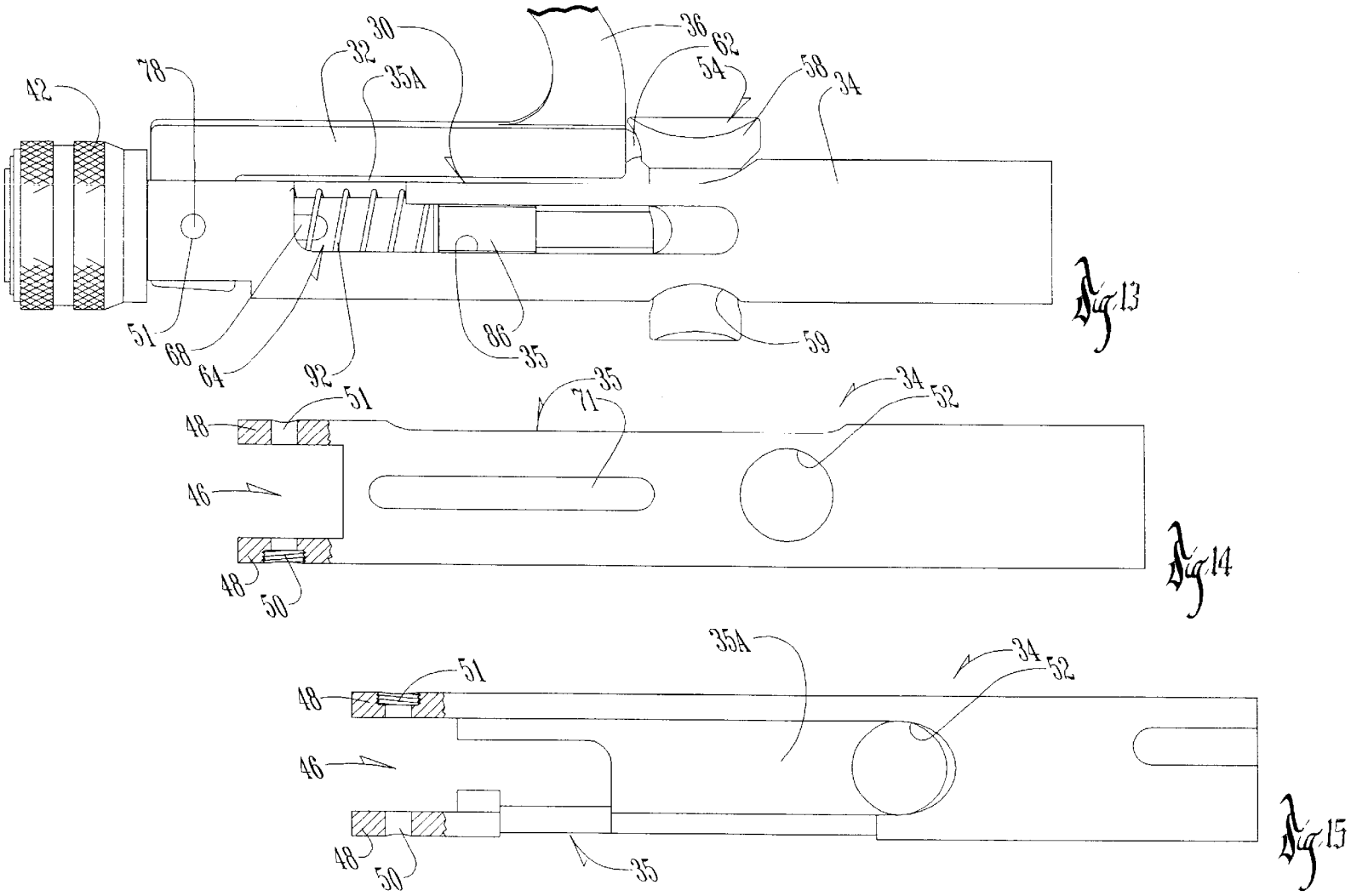
FIG. 13 is a bottom plan view of the bolt assembly.
FIG. 14 is a side elevation of a bolt segment.
FIG. 15 is a side elevation of the side of the bolt segment opposite to that of FIG. 14.

A transverse slot 46 is located in the rearward end of bolt segment 34 and is encompassed by upper and lower flanges 48. (FIGS. 9, 14 and 15). Vertically disposed apertures 50 and 51 are aligned and are located in the flanges 48 for a purpose to be described hereafter. Aperture 50 is threaded and aperture 51 is smooth and is of smaller diameter. As shown in FIG. 9, a transverse bore 52 extends through bolt segment 34 to slidably receive cross lug 54. A transverse slot 56 extends through lug 54. One end of the lug 54 terminates in head 58. Head 58 is adapted to be received within arcuate notch 29 located at the forward end of longitudinal slot 28 in the receiver 16. The end of lug 54 opposite to head 58 is normally slidably positioned in aperture 59 (FIG. 7) in receiver 16 when the bolt is in its locked position(FIG. 8). As shown in FIG. 11, the head 58 has a longitudinal extending aperture 60 therein to receive a pivot stud element 62 on bolt slide 32.

A striker pin 64 (FIG. 9) has a threaded rearward end which is adapted to be threadably inserted into the bore 44 of safety knob 42 to secure the knob 42 to the striker pin. An elongated vertical longitudinally positioned slot 68 is formed in striker pin 64 immediately forward of threads 66 (FIG. 9).

As shown in FIG. 3, a bolt retention screw 70 is threadably mounted in a threaded aperture in receiver 16 and extends therethrough to engage an elongated slot 71 in bolt segment 34. The ends of slot 71 limit the longitudinal movement of the bolt 30 and prevent the bolt from ever dropping rearwardly out of the rifle 10.

A transverse lug 72 extends inwardly from the rearward end of bolt slide 32 (FIG. 9) and has a horizontally disposed bore 74. A threaded aperture 76 having a vertical axis extends through lug 72 (FIG. 9) and is adapted to receive pin 78 (FIG. 10) which extends through the registering apertures 50 and 51 (in bolt segment 34) and the aperture 76 in lug 72. The upper end 79 is threaded and is received in threaded aperture 50. The lower end slides into aperture 51. (FIGS. 9 and 10).

The striker pin 64 is comprised of a first segment 80 of larger diameter, and intermediate segment 82 of an intermediate diameter, and a forward segment 84 of a smaller diameter (FIG. 9). A sear link 86 has a center bore 87 to slidably receive the intermediate segment 82 of striker pin 64. The sear link 86 has a laterally extending aperture 88 and when that aperture is aligned with aperture 89 in segment 82, the registering apertures then receive pin 90 to hold the sear link 86 on segment 82. A spring 92 then has one end bearing against the rearward end of sear link 86 and the other end bearing against lug 72 on bolt slide 32.

Figure 6:
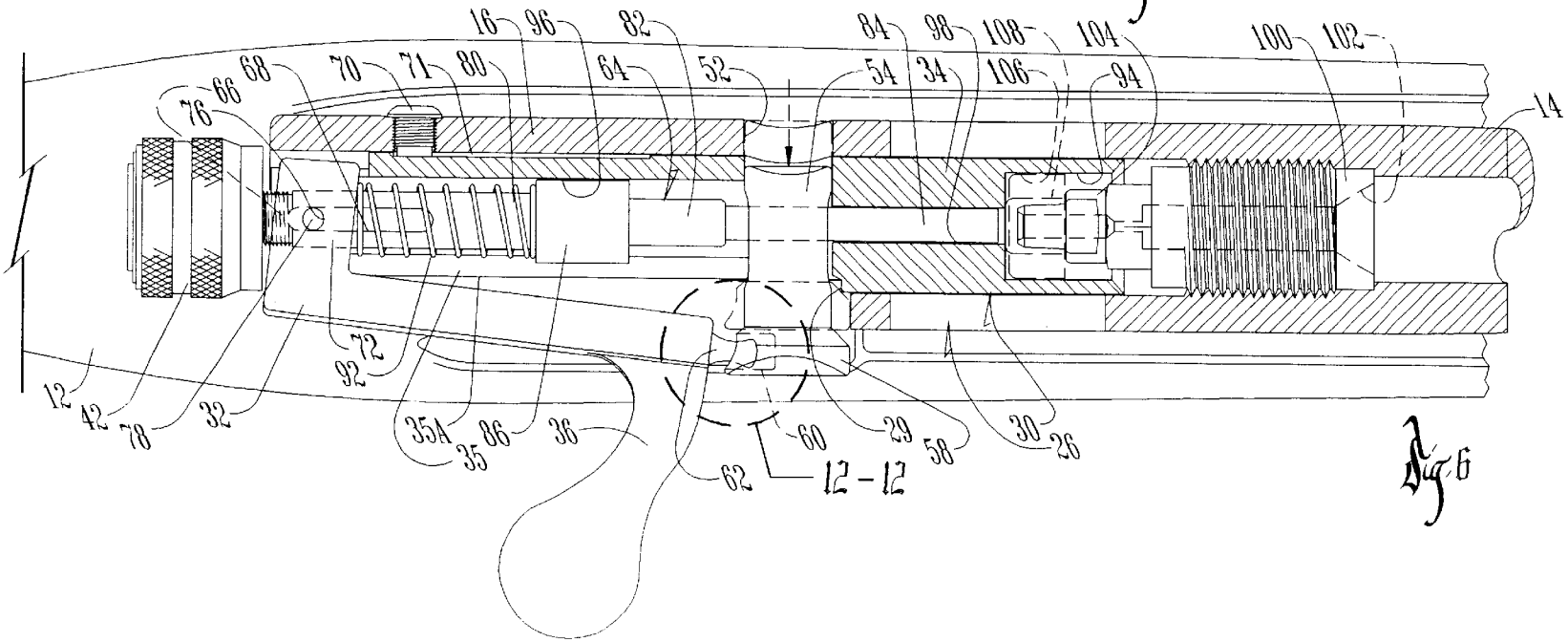
FIG. 6 is a partial sectional view similar to that of FIG. 3 but showing the bolt handle moved outwardly.

With reference to FIG. 9, bolt segment 34 has a larger diameter bore 94 in its forward end and a large diameter bore 96 in its rearward end which communicates with slot 46. A connecting bore 98 extends rearwardly from bore 94 to the bore 52. This allows the segment 84 of striker pin 64 to extend through bore 74 in lug 72; thence through the slot 56 in cress lug 54, thence through connecting bore 98, and thence into bore 94 at the forward end of bolt segment 34. (FIG. 6).

A breech plug 100 is threadable inserted into the rearward end of barrel 14 in conventional fashion, and includes a center bore 102. A conventional rear boss 104 is mounted on the rearward end of the breech plug 100 and has a percussion cap cup 106 at its rearward end which in turn is adapted to removably receive a conventional percussion cap 108.

Figure 2:
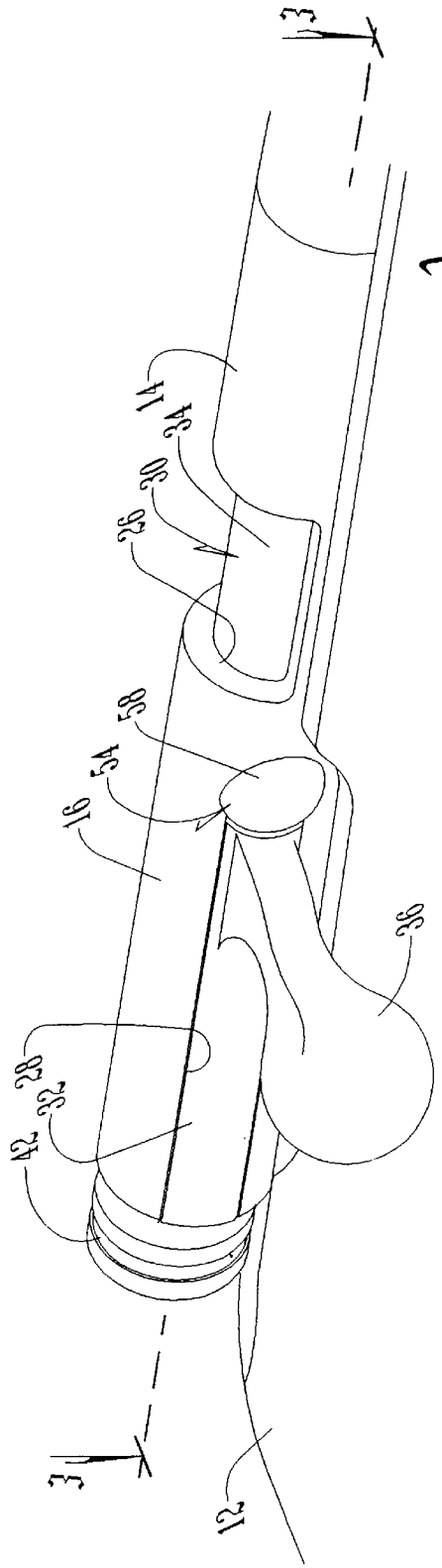
FIG. 2 is an enlarged scale partial perspective view taken on line 2—2 of FIG. 1.

In the normal operation of the device, the bolt 30 is in its closed position as best shown in FIGS. 2 and 5. The bolt is then pivoted laterally outwardly with respect to the receiver by grasping a bolt handle 36 and pulling it outwardly as shown in FIGS. 5 and 6. The bolt pivots about pin 78 at the rear at the same time, the pivot element 62 draws cross lug 54 outwardly to disengage the head 58 from the arcuate notch 29 at the forward end of the elongated slot 28 in the receiver. This frees the bolt, then in the position of FIG. 6, to be pulled rearwardly to the position shown in FIG. 7. This causes the forward end of the bolt segment 34 to be moved from the closed position of FIG. 2 to the open position of FIG. 5. A percussion cap 108 can then be loaded into the position of FIG. 7 while the breech opening 26 is completely clear by virtue of the bolt segment 34 moving rearwardly out of opening 26.

The rearward movement of the bolt 64 also moves the striker pin 64 rearwardly. The bolt handle 36 is then moved forwardly from the position of FIG. 7 to the position of FIG. 8 which causes cross lug 54 to move back into its locking position with the head 58 thereof being nestled in the forward arcuate notch 29 as shown in FIGS. 8 and 11. The end of lug 54 opposite to head 58 is then within aperture 59 of receiver 16 (FIG. 8). The forward end of the bolt segment 34 thereupon embraces the percussion cap 108 as shown in FIG. 8. The striker pin 64 is held in its rearward position by virtue of the trigger sear 23 as it performs the conventional function of the trigger assembly 22. When the trigger is pulled to release the striking pin which is resiliently held rearwardly by spring 92, the striker pin moves forwardly from the position of FIG. 8 to the positions of FIGS. 3 and 4 to strike the percussion cap 108 and to cause ignition of the cap and the conventional powder located forwardly of the breech plug 100.

The spring pressure from spring 92 exerted on lug 72, which is thence transferred to knob 42, tends to pivot bolt 30 from the pivotal position of FIG. 6 to the locked position of FIG. 3.

What is claimed:

1. An improvement in a muzzleloading rifle having a stock, a receiver, a forwardly extending barrel, a removable breech plug in the rearward end of the barrel and forwardly of the receiver, and a trigger mechanism, the improvement comprising, an elongated bolt assembly including a bolt slide, a bolt segment, and a bolt handle, the bolt slide having a rearward end pivotally secured within the receiver and adapted to be pivoted from an aligned position with and within the receiver to an angular position outwardly through a slot in the side of the receiver, a transverse cross lug mounted in a locking position within the receiver and having one end pivotally secured to the bolt slide so that when the bolt slide is pivoted outwardly from the receiver, the cross lug will be unlocked from the receiver to allow the bolt slide to be moved to a rearward position in the slot of the receiver, the bolt segment being operatively connected to an elongated striker pin in the bolt to pull the striker pin rearwardly against a compression spring, the trigger mechanism operatively releasably engaging and holding the striker pin against forward movement when the bolt slide is moved forwardly and thence pivoted laterally to resume the aligned position with the receiver.

2. The rifle of claim 1 wherein the striker pin is located in the center longitudinal axis of the bolt segment.

3. The rifle of claim 1 wherein the striker pin is straight and is adapted to be moved on the center axis of the bolt segment when in a firing mode.

4. The rifle of claim 3 wherein the striker pin slidably extends through an aperture in a lug forming a part of the bolt segment.

5. The rifle of claim 1 wherein the cross lug has an enlarged head on one end adapted to enter a first locking aperture in the receiver when in a locking position, with the other end being in a second locking aperture opposite the first locking aperture when the cross lug is in the locking position.

6. The rifle of claim 5 wherein the cross lug has an elongated slot therein, and the striking pin extends through the elongated slot to permit the cross lug to be moved laterally with respect to the striking pin.

* * * * *